US011828253B2

(12) United States Patent
Metzger et al.

(10) Patent No.: US 11,828,253 B2
(45) Date of Patent: Nov. 28, 2023

(54) AIR DUCT OF AN INTERNAL COMBUSTION ENGINE

(71) Applicant: MANN+HUMMEL GmbH, Ludwigsburg (DE)

(72) Inventors: Michael Metzger, Waiblingen (DE); Ralf Dietz, Remseck (DE); Andreas Link, Mundelsheim (DE)

(73) Assignee: MANN+HUMMEL GmbH, Ludwigsburg (DE)

( * ) Notice: Subject to any disclaimer, the term of this patent is extended or adjusted under 35 U.S.C. 154(b) by 115 days.

(21) Appl. No.: 17/401,032

(22) Filed: Aug. 12, 2021

(65) Prior Publication Data

US 2022/0049672 A1 Feb. 17, 2022

(30) Foreign Application Priority Data

Aug. 14, 2020 (DE) ..... 10 2020 121 385.9

(51) Int. Cl.
*F02M 35/12* (2006.01)
*F02M 35/10* (2006.01)
(Continued)

(52) U.S. Cl.
CPC .. *F02M 35/1255* (2013.01); *F02M 35/10144* (2013.01); *F02M 35/1272* (2013.01); *G10K 11/162* (2013.01); *G10K 11/172* (2013.01)

(58) Field of Classification Search
CPC ..... F02M 35/0218; F02M 35/10144; F02M 35/1255; F02M 35/1261; F02M 35/1266;
(Continued)

(56) References Cited

U.S. PATENT DOCUMENTS 8,316,987 B2 * 11/2012 Ishida ..... F02M 35/1272 181/247
9,945,335 B2 * 4/2018 Jackson ..... F02M 35/0218
(Continued)

FOREIGN PATENT DOCUMENTS

CN 106481385 A 3/2017
CN 107366594 A 11/2017
(Continued)

OTHER PUBLICATIONS

English translation of KR-101663177-B1, accessed Apr. 3, 2023 via USPTO search Tool (Year: 2016).*

*Primary Examiner* — Jeremy A Luks

(57) ABSTRACT

An air duct of an internal combustion engine has an inner pipe providing a flow channel and a housing with a first housing part and a second housing part, wherein the inner pipe is arranged in the housing. The first housing part and the second housing part enclose a chamber between the inner pipe and the housing. The inner pipe has at least one section with perforations in a wall of the inner pipe, wherein the perforations completely penetrate the wall of the inner pipe. A cylindrical acoustic component at least partially encloses the at least one section of the inner pipe at an outer side of the inner pipe. A wall of the cylindrical acoustic component is provided, at least in sections thereof, with continuous openings. The flow channel is acoustically connected via the perforations and via the continuous openings to the chamber.

19 Claims, 6 Drawing Sheets

(51) Int. Cl.
*G10K 11/172* (2006.01)
*G10K 11/162* (2006.01)

(58) Field of Classification Search
CPC ..... F02M 35/1272; F02M 35/1277; G10K 11/162; G10K 11/172
USPC ..... 181/229
See application file for complete search history.

(56) References Cited

U.S. PATENT DOCUMENTS

| | | | | |
|---|---|---|---|---|
| 2007/0186904 | A1* | 8/2007 | Braithwaite | F02M 35/10144 123/434 |
| 2011/0011670 | A1 | 1/2011 | Ishida et al. | |
| 2012/0222641 | A1* | 9/2012 | Mackenzie | F02M 35/1216 123/184.21 |
| 2012/0304629 | A1 | 12/2012 | Metzger | |
| 2014/0209051 | A1 | 7/2014 | Jackson | |
| 2016/0201531 | A1 | 7/2016 | Fletcher | |
| 2018/0142588 | A1* | 5/2018 | Qi | F02M 35/1261 |
| 2020/0191102 | A1* | 6/2020 | Poisson | F02M 35/024 |
| 2020/0232429 | A1* | 7/2020 | Satarino | F02M 35/1272 |

FOREIGN PATENT DOCUMENTS

| | | | |
|---|---|---|---|
| DE | 10026355 | A1 | 1/2002 |
| GB | 2554900 | A | 4/2018 |
| KR | 101636930 | B1 * | 7/2016 |
| KR | 101663177 | B1 * | 10/2016 |

* cited by examiner

AIR DUCT OF AN INTERNAL COMBUSTION ENGINE

TECHNICAL FIELD

The invention concerns an air duct of an internal combustion engine, in particular of a motor vehicle.

BACKGROUND OF THE INVENTION

It is known to provide flow ducts, for example, air ducts, in particular charge air ducts of internal combustion engines, with acoustic measures for noise reduction. For example, often silencer volumes, for example, of the type of broadband silencers with resonator chambers, are used.

Such a broadband silencer is known, for example, from DE 202014007986 U1.

Furthermore, it is known to provide air ducts with adsorber elements, in particular for hydrocarbons (HC). DE 102011104630 B4 discloses, for example, an adsorption unit of an intake manifold for combustion gas of an internal combustion engine, in particular of a motor vehicle, for adsorption of products of an incomplete combustion of hydrocarbons, the adsorption unit being arranged in an intake duct of the intake manifold.

SUMMARY OF THE INVENTION

It is the object of the invention to provide an air duct of an internal combustion engine, in particular of a motor vehicle, with an improved noise behavior.

The aforementioned object is solved according to an aspect of the invention by an air duct of an internal combustion engine, in particular of a motor vehicle, comprising an inner pipe as a flow channel for the fluid, in particular air, wherein the inner pipe is arranged in a housing at least comprising a first housing part and a second housing part, wherein the housing parts enclose at least one chamber between the inner pipe and the housing, wherein at least one section of the inner pipe comprises perforations in a wall of the inner pipe which penetrate the wall completely, wherein at least one cylindrical acoustic component is provided that surrounds at least partially the at least one section of the inner pipe at an outer side of the inner pipe, and wherein a wall of the at least one acoustic component comprises, at least in sections thereof, continuous openings via which the flow channel, via the perforations, is connected acoustically to the at least one chamber.

Beneficial embodiments and advantages of the invention result from the further claims, the description, and the drawing.

An air duct of an internal combustion engine, in particular of a motor vehicle, is proposed comprising an inner pipe as a flow channel for the fluid, in particular air, wherein the inner pipe is arranged in the housing at least comprising a first housing part and a second housing part, wherein the housing parts enclose at least one chamber between inner pipe and housing. In this context, at least one section of the inner pipe comprises perforations in a wall of the inner pipe which penetrate the wall completely. At least one cylindrical acoustic component is provided that at least partially surrounds the at least one section of the inner pipe at an outer side of the inner pipe. In this context, a wall of the at least one acoustic component comprises, at least in sections thereof, continuous openings via which the flow channel is connected acoustically via the perforations to the at least one chamber.

The chamber can be a resonator chamber or a silencer chamber, in particular a broadband silencer chamber.

The air duct according to the invention comprises an inner pipe as it is used usually in air duct systems with adsorber elements for adsorption, for example, of hydrocarbons (HO). Since in this context noise development by exhaust gas turbo chargers and motor excitations may occur, such an air duct is usually furnished with silencer elements, for example, broadband silencers which improve the noise behavior.

The air duct according to the invention comprises now an additional acoustic component which, as needed, can be pushed or clipped in a simple way onto the inner pipe as a carrier pipe and decisively improves the noise behavior in this way. The inner pipe comprises for this purpose acoustic perforations via which a portion of the air flow, via openings in the wall of the acoustic component, is in acoustic connection with a chamber which is arranged between the inner pipe and the housing of the air duct. In this way, a broadband silencing action for the air conduction in the flow channel is generated.

The acoustic component must be arranged only on a portion of the inner pipe, i.e., a defined section, in order to generate the desired silencing properties.

In this context, the acoustic component can be pushed advantageously onto the inner pipe, namely without adsorber element but also with an adsorber element which is then arranged on an outer side of the inner pipe between inner pipe and acoustic component. In this way, the air duct can be installed very flexibly and can be used without as well as with an adsorber element in an internal combustion engine. In this context, the acoustic component can be embodied advantageously as a broadband silencer.

The invention is however not limited to broadband silencers but can also be used in connection with other resonators, for example, Helmholtz resonators or pipe resonators.

Complex measures for avoiding disturbing noises can be avoided, such as the reduction of the opening cross sections, which changes the actual acoustic performance of the component; covering the openings with a fine mesh lattice, which causes additional costs; or the enlargement of the complete pipe cross section in order to reduce the flow speed, which requires installation space which is usually not available.

The openings in the acoustic component can be designed arbitrarily, as round holes, slotted holes, slots, parallel to the longitudinal axis, perpendicular to the longitudinal axis, at a slant to the longitudinal axis, or combinations of different configurations of openings.

In this way, a robust, easily produced measure can be provided that reduces disturbing noises without diminishing the acoustic silencing action and, simultaneously, triggers no increase of pressure loss in the air duct.

According to a beneficial embodiment of the air duct, the at least one acoustic component can comprise a slot along the longitudinal axis or can be configured of multiple parts. In this way, the acoustic component can be widened for mounting on the inner pipe and can be pushed over the inner pipe. As an alternative, it is also possible to simply push the acoustic component onto the inner pipe. In case of a multipart configuration, the acoustic component can be joined in a suitable way, for example, glued or welded or screwed or the like.

According to a beneficial embodiment of the air duct, the at least one acoustic component can be arranged as a sleeve about the at least one section. After completed mounting, the acoustic component can thus enclose the inner pipe as a cylinder wherein a possible slot provided for mounting is closed again.

The at least one cylindrical acoustic component can have a particularly wide slot according to a beneficial embodiment. In the embodiment, the acoustic component comprises across the circumference an open region of 10° to 45°, in particular of 20° to 30°, in relation to the circumference. The at least one acoustic component for mounting on the inner pipe can be elastically bent open in order to be pushed thus radially or axially onto the inner pipe. After mounting, the opening closes again due to the inherent elasticity of the acoustic component so that the inner pipe is tightly enclosed. In this way, the acoustic component is arranged fixedly on the inner pipe. In an advantageous embodiment, the radially outer acoustic component fixes with form fit the adsorber element.

According to a beneficial embodiment of the air duct, the at least one acoustic component can be designed as a broadband silencer or resonator. Broadband silencers provide a very expedient possibility to improve the noise behavior of the air duct decisively. The invention is however not limited to broadband silencers but can also be used in connection with other resonators, for example, Helmholtz resonators or pipe resonators.

According to a beneficial embodiment of the air duct, the wall of the inner pipe can be embodied in the at least one section, at least in sections thereof, as a lattice with stays that extends longitudinally and transversely. In this way, a sufficient acoustic exchange between the flow channel and the acoustic component or the chamber can be realized in order to provide the desired acoustic properties. At the same time, the inner pipe maintains enough stability in order to carry the acoustic component. Also, due to the lattice, in case of a possible mounting of an adsorber element between inner pipe and acoustic component, hydrocarbons in the air flow can be adsorbed from the air in a suitable manner.

According to a beneficial embodiment of the air duct, the inner pipe can comprise at least two sequentially arranged sections each provided with an acoustic component. The acoustic components can thus exhibit, due to varying configuration of the openings, different acoustic properties and cover a broader acoustic spectrum for noise silencing in this way.

In a further advantageous embodiment of the inner pipe, an acoustic component and an adsorber element are provided in a first section and in a second section of the inner pipe, respectively. Other embodiments with a deviating number of acoustic components and adsorber elements can be advantageous in other applications. Alternatively, the components can comprise different slot widths or opening angles.

According to a beneficial embodiment of the air duct, the inner pipe can comprise openings upstream and/or downstream of the section along the longitudinal axis, wherein the openings are in fluid communication with the volume arranged between the inner pipe and the inner wall of the housing. In this way, an additional venting of an adsorber element as well as of the acoustic component can be realized.

According to a beneficial embodiment of the air duct, the inner pipe can comprise at least one opening connected in fluid communication with the volume and/or the chamber. Via the opening, an additional flow path for the air flow can be provided which leads to the outwardly positioned volume between inner pipe and housing wall. In this way, a suitable venting of an adsorber element as well as of the acoustic component can be realized.

According to a beneficial embodiment of the air duct, between the outer side of the inner pipe and the acoustic component an adsorber element with at least one adsorber medium, in particular embodied as a nonwoven, is arranged. The adsorber medium can be configured as a flat nonwoven with a thickness of, for example, 2 to 4 mm. The nonwoven is acoustically permeable and changes thus the acoustic properties of the acoustic component arranged above at most minimally. The nonwoven can comprise, for example, a synthetic fiber fabric. The nonwoven can be sealed, for example, at the outer edges by a liquid adhesive. The adsorber medium can expediently be rolled as a cylinder in order to be pushed onto the inner pipe.

Advantageously, the adsorber element can be used as an HO trap in a clean air flow, in particular in a motor vehicle, in which, when the internal combustion engine is shut down, hydrocarbons (HO) that diffuse back can be adsorbed from the clean air.

The adsorber element can be mounted in a modular manner in addition on the inner pipe. With the same geometry, the inner pipe in this context can be used with as well as without adsorber element. The acoustic component, with employed adsorber element, can be arranged simply on an outer side over the adsorber element.

According to a beneficial embodiment of the air duct, the adsorber element can be embodied cylindrical and at least surround the at least one section of the inner pipe at the outer side of the inner pipe. The adsorber medium can be expediently rolled as a cylinder in order to be pushed onto the inner pipe. The adsorber element can thus surround the inner pipe as much as possible without a spacing so that it encloses it tightly and fulfills its adsorption function favorably. Also, the acoustic component can thus be easily arranged on top.

According to a beneficial embodiment of the air duct, the adsorber element can be slotted along the longitudinal axis and can be placed or pushed as a sleeve about the inner pipe, in particular as an overlapping sleeve. In this way, the adsorber element can be easily mounted in a suitable manner but still tightly enclose the inner pipe so that it is can favorably fulfill its adsorber effect.

According to a beneficial embodiment of the air duct, the adsorber medium can comprise at least one active carbon-containing layer, comprising a gas-permeable carrier layer on which an active carbon layer is arranged. In particular, the active carbon layer can be covered with a gas-permeable holding layer.

The active carbon layer can be formed by a fluid-permeable adhesive layer on which active carbon particles are applied. Advantageously, the adsorber medium can be formed by a plurality of such layers. The number of the layers can be selected as needed.

Advantageously, the active carbon layer can be covered with a gas-permeable holding layer. In this way, the active carbon layer can be fixed safely on the carrier layer and can build a self-supporting active carbon-containing layer.

According to a beneficial embodiment of the air duct, the air duct can be arranged at a clean air side of an air inlet of the internal combustion engine or at a raw air side of an air inlet of the internal combustion engine. Due to the modular configuration of the air duct, it can be used flexibly for various purposes of use. The air duct can be used in fields where additional HC adsorption is needed in that an adsorber element can be used selectively. The air duct can be used however also in fields where such an adsorption element is not needed, for example, in clean air ducts. In any case, the acoustic component can be used in order to suitably silence the noise behavior of the air duct.

BRIEF DESCRIPTION OF THE DRAWINGS

Further advantages result from the following drawing description. In the drawings, embodiments of the invention are illustrated. The drawings, the description, and the claims contain numerous features in combination. A person of skill in the art will consider the features expediently also individually and combine them to expedient further combinations.

DESCRIPTION OF PREFERRED EMBODIMENTS

Figure 1:
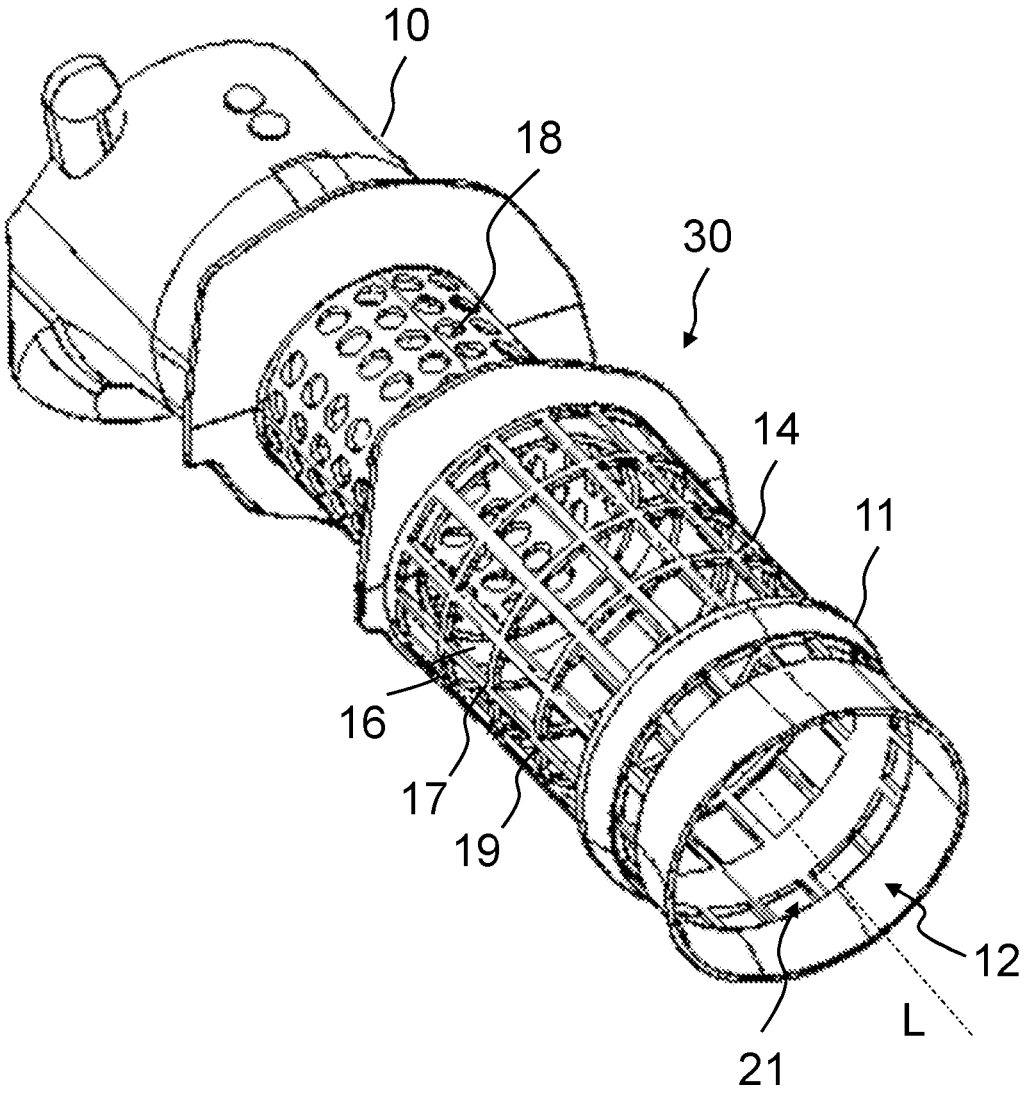
FIG. 1 shows an inner pipe of an air duct according to an embodiment of the invention in an isometric illustration.

In the Figures, same or similar components are identified with same reference characters.

Figure 2:
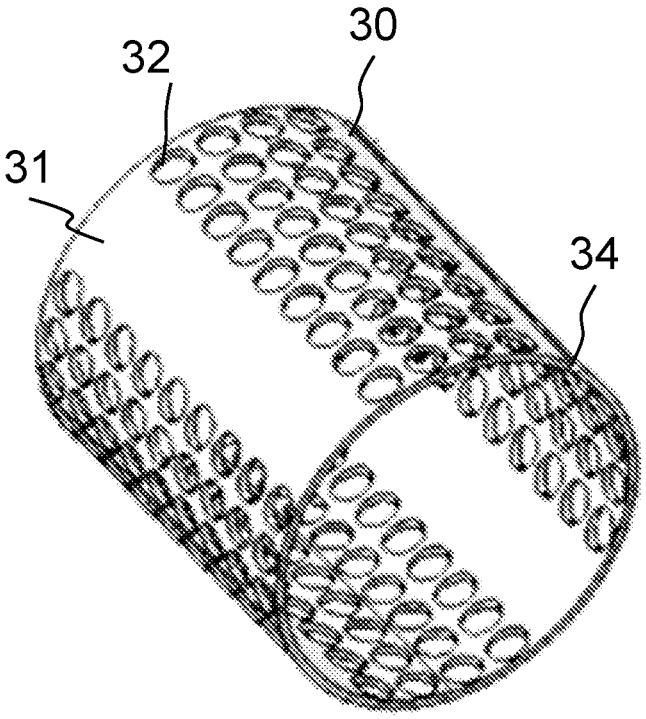
FIG. 2 shows an acoustic component for an air duct according to an embodiment of the invention in isometric illustration.
Figure 3:
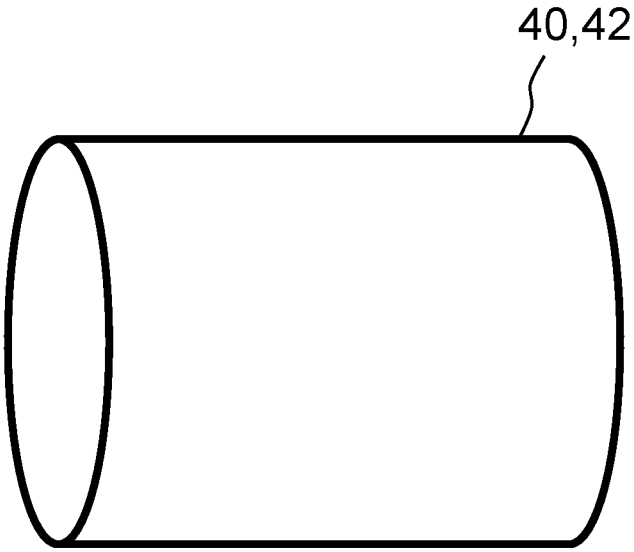
FIG. 3 shows an adsorber element for an air duct according to an embodiment of the invention in isometric illustration.
Figure 4:
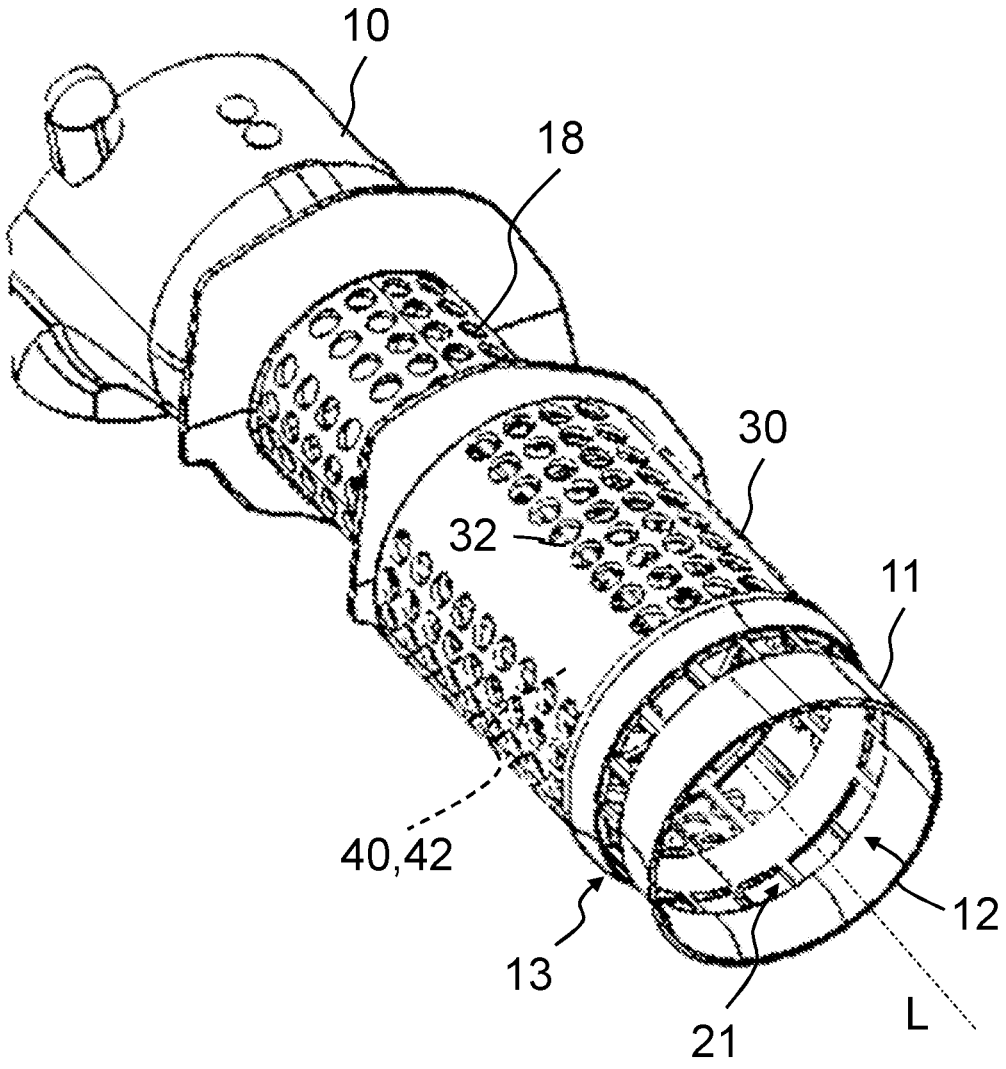
FIG. 4 shows the inner pipe of FIG. 1 with the mounted acoustic component of FIG. 2.
Figure 5:
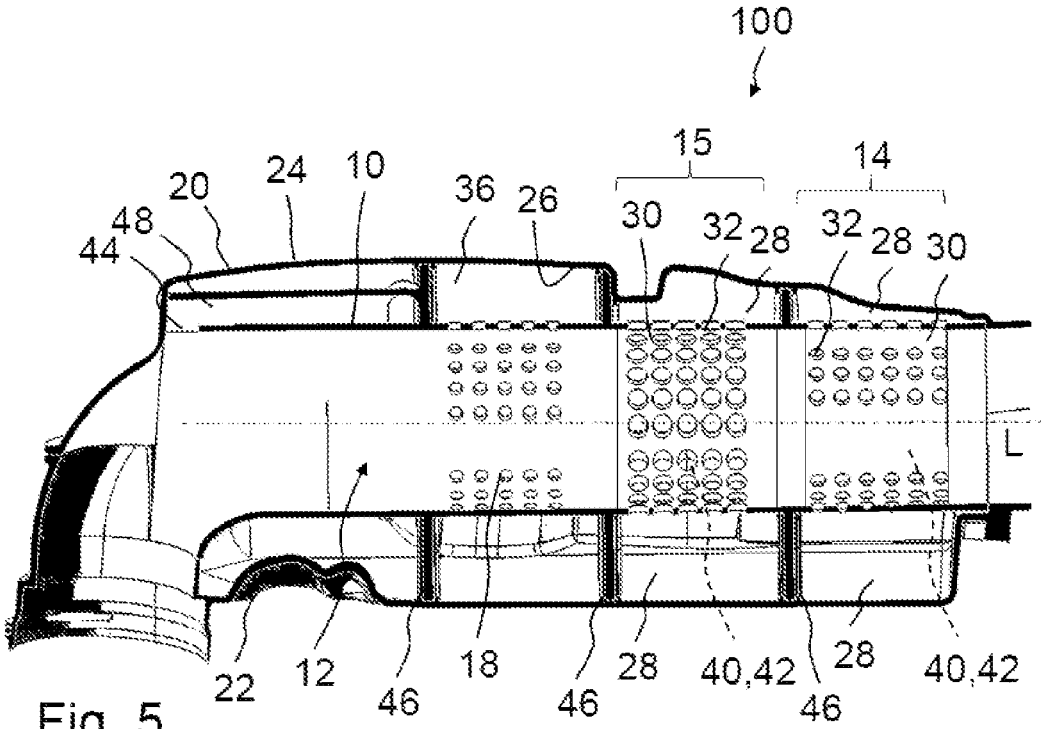
FIG. 5 shows a longitudinal section of an air duct according to a further embodiment of the invention.
Figure 9:
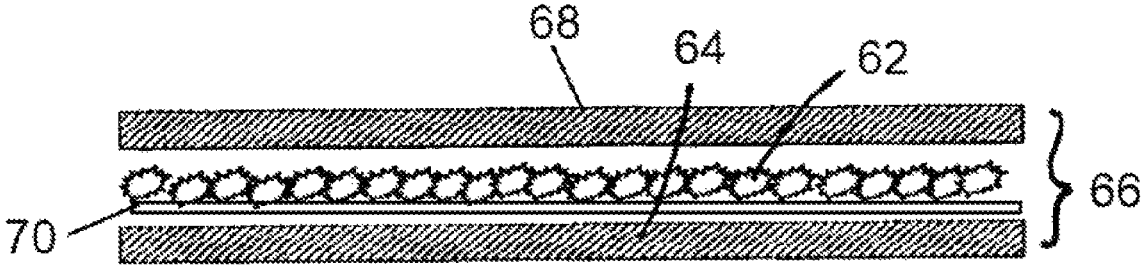
FIG. 9 schematically shows the adsorber medium with is various layers.
Figure 6:
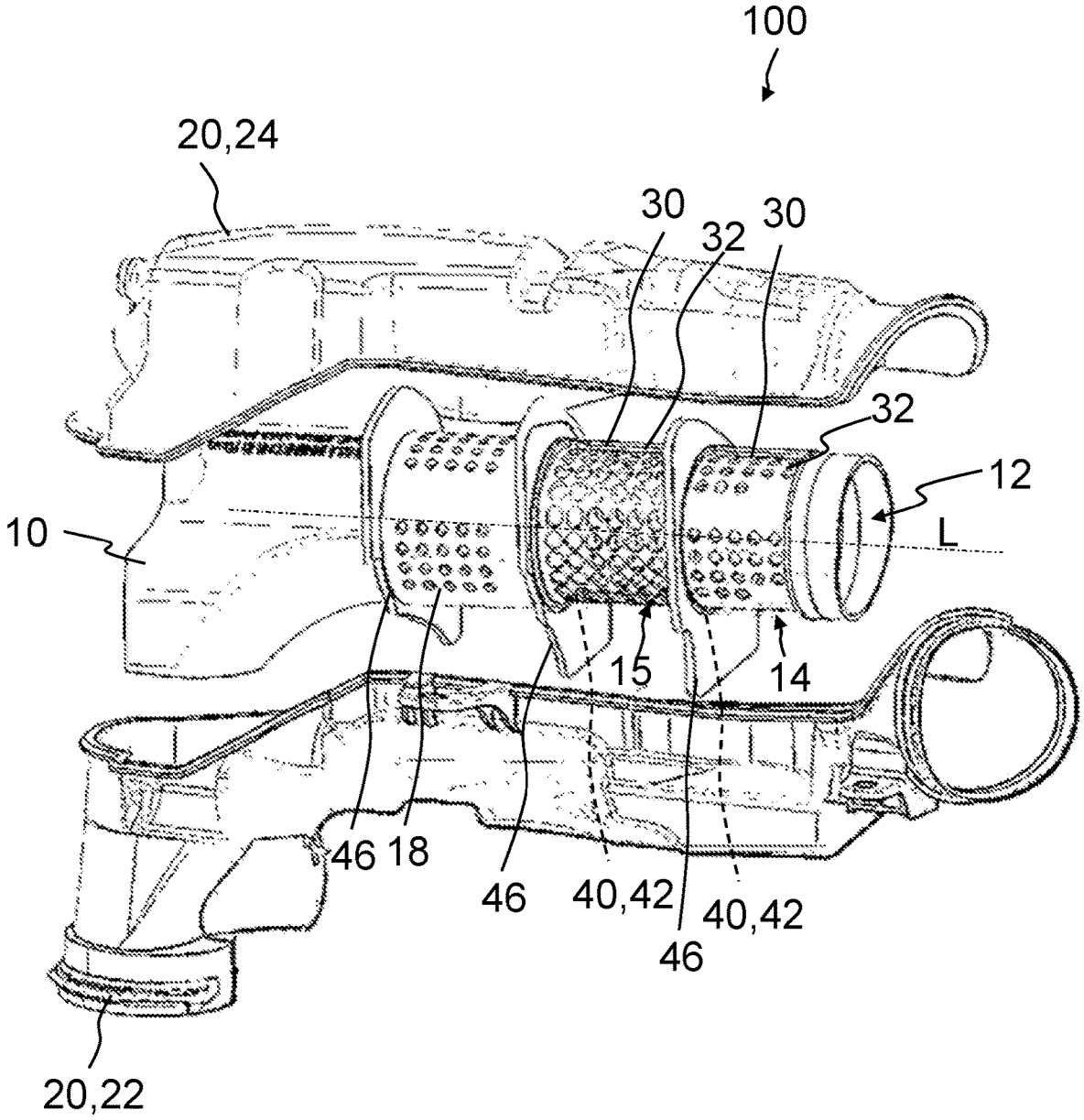
FIG. 6 shows an exploded illustration of the air duct according to FIG. 5.
Figure 7:
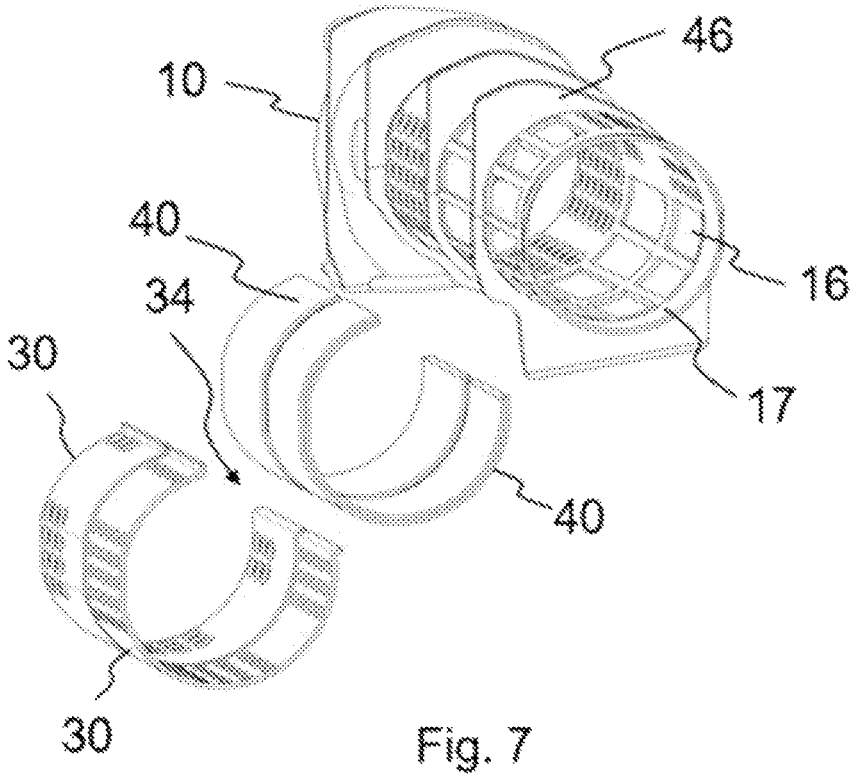
FIG. 7 shows an exploded illustration of an inner pipe of an air duct in a further embodiment.
Figure 8:
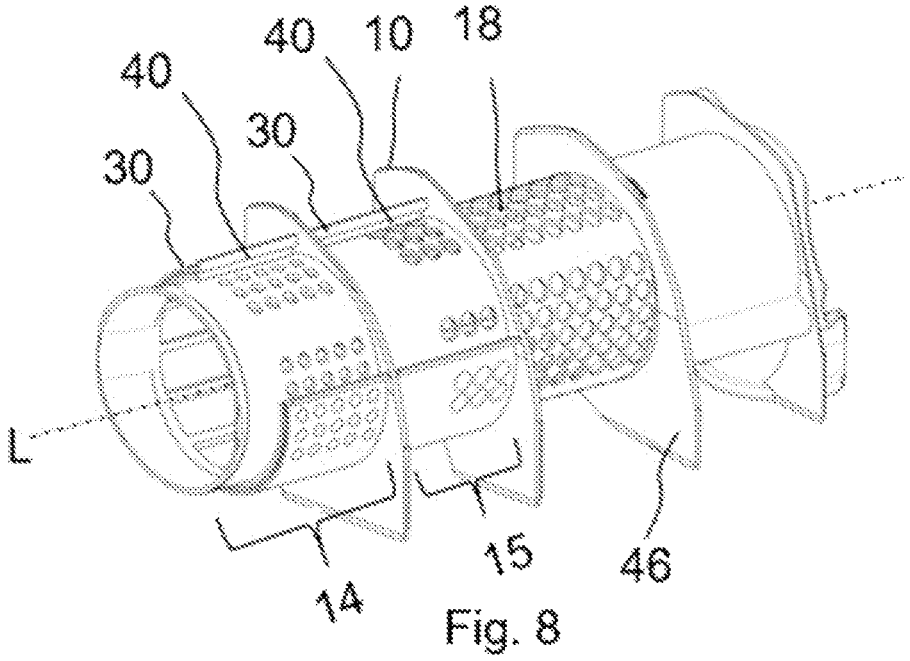
FIG. 8 shows the inner pipe of FIG. 7 with the mounted acoustic component.

FIG. 1 shows an inner pipe 10 of an air duct 100 according to an embodiment of the invention in isometric illustration, while FIG. 2 shows an acoustic component 30 for an air duct 100 according to an embodiment of the invention in isometric illustration and FIG. 3 shows an optional adsorber element 40 for an air duct 100 according to an embodiment of the invention in isometric illustration. In FIG. 4, the inner pipe 10 of FIG. 1 is illustrated with the mounted acoustic component of FIG. 2 while FIG. 5 shows a longitudinal section of an air duct 100 with three sequentially arranged chambers 48, 28 according to a further embodiment of the invention. FIG. 6 shows in this context an exploded illustration of an air duct according to the further embodiment of the invention. FIGS. 7 and 8 show further embodiments in which acoustic components 30 and adsorber elements 40 comprise a particularly wide slot at the circumference.

As can be seen in particular in FIG. 5, the air duct 100 of an internal combustion engine, in particular of a motor vehicle, comprises an inner pipe 10 as a flow channel 12 for the fluid, in particular air. In this context, the inner pipe 10 is arranged in a housing 20 with a first housing part 22 and a second housing part 24. The housing parts 22, 24 enclose in the mounted state at least one chamber 28 between inner pipe 10 and housing 20. The chamber 28 can be a resonator chamber or a broadband silencer chamber.

In FIG. 1, it can be seen that at least one section 14 of the inner pipe 10 comprises perforations 16 in a wall 11 of the inner pipe 10 which completely penetrate the wall 11. For this purpose, the wall 11 of the inner pipe 10 is embodied in the at least one section 14, at least in sections thereof, as a lattice 17 with stays 19 extending longitudinally and transversely.

At least one cylindrical acoustic component 30 is provided that surrounds the at least one section 14 of the inner pipe 10 at an outer side 13 of the inner pipe 10 at least partially, as can be seen in FIG. 4.

A wall 31 of the at least one acoustic component 30 which is illustrated in FIG. 2 comprises, at least in sections thereof, continuous openings 32 via which the flow channel 12 via the perforations 16 is acoustically connected with the at least one chamber 28. In this way, the silencing properties of the acoustic component 30 can become effective in interaction with the chamber 28. For this purpose, the at least one acoustic component 30 can be designed advantageously as a broadband silencer.

As illustrated in an exemplary fashion in FIG. 4, the at least one acoustic component 30 is arranged as a sleeve about the at least one section 14 of the inner pipe 10. For mounting the acoustic component 30 on the inner pipe 10, the acoustic component 30 can comprise a slot 34 along the longitudinal axis L. In this way, the acoustic component 30 can be, for example, bent open in order to be thus pushed onto the inner pipe 10. After mounting, the slot 34 closes again due to the inherent elasticity of the acoustic component which is manufactured of plastic material, for example, as an injection molded part. In this way, the acoustic component 30 is subsequently seated fixedly enclosing the inner pipe 10.

The inner pipe 10 comprises openings 18 upstream and/or downstream of the section 14 along the longitudinal axis L which are acoustically connected with a volume 36 that is arranged between the inner pipe 10 and the inner wall 26 of the housing 20.

Between the outer side 13 of the inner pipe 10 and the acoustic component 30, optionally an adsorber element 40 with at least one adsorber medium 42, in particular embodied as nonwoven, can be arranged. The adsorber medium 42 can be provided in particular for adsorption of hydrocarbons (HO).

Such an adsorber element 40 is illustrated in FIG. 3. The adsorber element 40 is embodied cylindrical and surrounds at least the at least one section 14 of the inner pipe 10 at the outer side 13 of the inner pipe 10.

The adsorber element 40, like the acoustic component 30, can be slotted along the longitudinal axis L and can be placed or pushed as a sleeve about the inner pipe 10, in particular as an overlapping sleeve.

The adsorber medium 42 can comprise at least one active carbon-containing layer, comprising a gas-permeable carrier layer on which an active carbon layer is arranged. In particular, the active carbon layer can be covered by a gas-permeable holding layer.

Since the adsorber element 40 in the mounted state is arranged between inner pipe 10 and the acoustic component 30, it cannot be directly seen in FIGS. 4 and 5 so that the lead lines of the reference characters are therefore illustrated in dashed lines.

In a further embodiment which is illustrated in FIGS. 5 and 6, the inner pipe 10 can also comprise two sections 14, 15 following each other and each comprising an acoustic component 30, as can be seen in longitudinal section in FIG. 5 as well as in the exploded illustration in FIG. 6. In this context, both sections 14, 15 are provided with an acoustic component 30, respectively, wherein the openings 32 of the acoustic component 30 can be embodied differently, respectively, in order to realize different acoustic silencing properties.

The resonator chambers 28 or broadband silencing chambers 28 in the sections 14 and 15, as well as the volume 36, are separated from each other by separating walls 46 which are connected to the inner pipe 10 so that the corresponding air volumes are decoupled. In front of the chambers 28, a further resonator chamber 48 with a volume is arranged.

Furthermore, the inner pipe 10 comprises a bypass opening 44 with an acoustic connection to the resonator chamber 48 in front of the volume 36, in FIG. 5 to the left of volume 36, as can be seen in longitudinal section in FIG. 5. Venting can be realized via openings 21 (FIGS. 1, 4). In this way, a suitable venting of an adsorber element as well as also of the acoustic component can be realized.

In a non-illustrated embodiment, such a venting action can also be dispensed with. In this context, the acoustic component 30 can be provided in combination with the adsorber element 40 or even without adsorber element 40.

FIG. 7 shows in an exploded illustration a further embodiment of an inner pipe 10 of an air duct 100 and a further embodiment of an optional adsorber element 40. A cylindrical acoustic component 30 comprises a wide slot 34 so that the acoustic component is not closed about the circumference, in particular comprises an open region of 10° to 45°, in particular of 20° to 30°, in relation to the circumference.

Between the outer side 13 of the inner pipe 10 and the acoustic component 30, an adsorber element 40 with at least one adsorber medium 42, in particular embodied as a nonwoven, can be optionally arranged. The at least one cylindrical adsorber element 40 comprises a wide slot 34 so that the adsorber element 40 is not closed about the circumference, in particular comprises an open region of 10° to 45°, in particular of 20° to 30°.

As illustrated in an exemplary fashion in FIG. 8, the at least one acoustic component 30 and the at least one adsorber element 40 are arranged like a sleeve about the at least one section 14 of the inner pipe 10. For mounting the acoustic component 30 and the adsorber element 40 on the inner pipe 10, the components can be elastically bent open, for example, in order to be pushed thus radially or axially onto the inner pipe 10. After mounting, the slot 34 then closes again due to the inherent elasticity of the acoustic component 30 which is manufactured of plastic material, for example, as an injection molded part. In this way, the acoustic component 30 is arranged fixedly on the inner pipe 10. The radially outer acoustic component 30 fixes with form fit the adsorber element 40 in an advantageous embodiment.

The inner pipe 10 comprises openings 18 upstream and/or downstream of the section 14 along the longitudinal axis L which are acoustically connected with a volume 36 which is arranged between the inner pipe 10 and the inner wall 26 of the housing 20. The adsorber medium 42 can be provided in particular for adsorption of hydrocarbons (HO).

In an embodiment of the inner pipe according to FIGS. 7 and 8, an acoustic component 30 and an adsorber element 40 are provided in a first section 14 and a second section 15, respectively. Other embodiments with a deviating number of acoustic components and adsorber elements can be advantageous in other applications. Alternatively, the components can comprise different slot widths.

The air duct 100 according to the invention can be arranged in general at a clean air side of an air inlet of the internal combustion engine or at a raw air side of an air inlet of the internal combustion engine. At the clean air side, the air duct can be embodied without adsorber element.

According to a beneficial embodiment of the air duct, the adsorber medium can comprise at least one active carbon-containing 66 layer, comprising a gas-permeable carrier layer 64 on which an active carbon layer 66 is arranged. In particular, the active carbon layer 66 can be covered with a gas-permeable holding layer 68.

The active carbon layer 62 can be formed by a fluid-permeable adhesive layer 70 on which active carbon particles are applied. Advantageously, the adsorber medium can be formed by a plurality of such layers 66. The number of the layers can be selected as needed.

Advantageously, the active carbon layer can be covered with a gas-permeable holding layer 68. In this way, the active carbon layer can be fixed safely on the carrier layer and can build a self-supporting active carbon-containing layer.

What is claimed is:

1. An air duct of an internal combustion engine, the air duct comprising:

an inner pipe comprising a flow channel;

a housing comprising a first housing part and a second housing part, wherein the inner pipe is arranged in the housing, and wherein the first housing part and the second housing part enclose at least one chamber disposed between the inner pipe and the housing;

wherein the inner pipe comprises at least one section comprising perforations in a wall of the inner pipe, wherein the perforations completely penetrate the wall of the inner pipe;

at least one cylindrical acoustic component at least partially enclosing the at least one section of the inner pipe at an outer side of the inner pipe, the at least one cylindrical acoustic component elastically fit along the outer side of the inner pipe;

wherein a wall of the at least one cylindrical acoustic component comprises, at least in sections thereof, continuous openings;

wherein the flow channel is acoustically connected via the perforations and via the continuous openings to the at least one chamber.

2. The air duct according to claim 1, wherein the at least one cylindrical acoustic component comprises a slot extending along a longitudinal axis of the inner pipe.

3. The air duct according to claim 2, wherein the at least one cylindrical acoustic component is comprised of a multi-part configuration.

4. The air duct according to claim 1, wherein the at least one cylindrical acoustic component is comprised of a multi-part configuration.

5. The air duct according to claim 1, wherein the at least one cylindrical acoustic component is a sleeve arranged about the at least one section.

6. The air duct according to claim 1, wherein the at least one chamber is a broadband silencer chamber or a resonator chamber.

7. The air duct according to claim 1, wherein the at least one cylindrical acoustic component is a broadband silencer or a resonator.

8. The air duct according to claim 1, wherein the at least one section, at least in sections thereof, is a lattice with stays extending longitudinally and transversely.

9. The air duct according to claim 1, wherein the inner pipe comprises two or more of the at least one section arranged sequentially and wherein the two or more of the at least one section each comprise one of the at least one cylindrical acoustic component.

10. The air duct according to claim 1, wherein the inner pipe comprises first openings upstream and/or downstream of the at least one section along a longitudinal axis of the inner pipe, wherein the first openings of the inner pipe are acoustically connected to a volume arranged between the inner pipe and an inner wall of the housing.

11. The air duct according to claim 10, wherein the inner pipe comprises at least one second opening with an acoustic connection to the volume arranged between the inner pipe and the inner wall of the housing and/or to the at least one chamber disposed between the inner pipe and the housing.

12. The air duct according to claim 1, further comprising an adsorber element comprising at least one absorber medium, wherein the adsorber element is arranged between the outer side of the inner pipe and the at least one cylindrical acoustic component.

13. The air duct according to claim 12, wherein the at least one adsorber medium is a nonwoven.

14. The air duct according to claim 13, wherein the adsorber element is cylindrical and surrounds at least the at least one section of the inner pipe at the outer side of the inner pipe.

15. The air duct according to claim 12, wherein the adsorber element is a sleeve and comprises a slot extending along a longitudinal axis of the inner pipe, wherein the sleeve is placed or pushed about the inner pipe.

16. The air duct according to claim 12, wherein the at least one adsorber medium comprises at least one active carbon-containing layer, wherein the active carbon-containing layer comprises a gas-permeable carrier layer and an active carbon layer arranged on the gas-permeable carrier layer.

17. The air duct according to claim 16, wherein the at least one active carbon-containing layer further comprises a gas-permeable holding layer covering the active carbon layer.

18. The air duct according to claim 1, wherein the air duct is configured to be arranged at a clean air side of an air inlet of the internal combustion engine or at a raw air side of an air inlet of the internal combustion engine.

19. The air duct according to claim 12, wherein the at least one cylindrical acoustic component elastically secures the adsorber element along the outer side of the inner pipe.

* * * * *